US009263051B2

(12) United States Patent
Vos

(10) Patent No.: US 9,263,051 B2
(45) Date of Patent: Feb. 16, 2016

(54) SPEECH CODING BY QUANTIZING WITH RANDOM-NOISE SIGNAL

(71) Applicant: Skype, Dublin (IE)

(72) Inventor: Koen Bernard Vos, San Francisco, CA (US)

(73) Assignee: Skype, Dublin (IE)

( * ) Notice: Subject to any disclaimer, the term of this patent is extended or adjusted under 35 U.S.C. 154(b) by 0 days.

(21) Appl. No.: 14/182,196

(22) Filed: Feb. 17, 2014

(65) Prior Publication Data

US 2014/0163973 A1 Jun. 12, 2014

Related U.S. Application Data

(63) Continuation of application No. 12/455,632, filed on Jun. 4, 2009, now Pat. No. 8,655,653.

(30) Foreign Application Priority Data

Jan. 6, 2009 (GB) ..... 0900145.4

(51) Int. Cl.

| | |
|---|---|
| ***G10L 21/02*** | (2013.01) |
| ***G10L 19/04*** | (2013.01) |
| ***G10L 25/93*** | (2013.01) |
| ***G10L 19/032*** | (2013.01) |

(52) U.S. Cl.

CPC ..... *G10L 19/032* (2013.01); *G10L 19/04* (2013.01); *G10L 25/93* (2013.01)

(58) Field of Classification Search

CPC ..... G10L 19/04; G10L 19/18; G10L 21/02; G10L 25/93; G10L 19/032

USPC ..... 704/203, 208, 214, 219, 226, 227, 228, 704/229, 230

See application file for complete search history.

(56) References Cited

U.S. PATENT DOCUMENTS

| | | | | |
|---|---|---|---|---|
| 4,605,961 | A * | 8/1986 | Frederiksen | 380/215 |
| 4,850,022 | A | 7/1989 | Honda et al. | |
| 4,857,927 | A | 8/1989 | Takabayashi | |
| 4,916,449 | A * | 4/1990 | Kubo et al. | 341/131 |
| 4,922,537 | A * | 5/1990 | Frederiksen | 704/212 |
| 5,125,030 | A | 6/1992 | Nomura et al. | |
| 5,240,386 | A | 8/1993 | Amin et al. | |

(Continued)

FOREIGN PATENT DOCUMENTS

| | | |
|---|---|---|
| CN | 1255226 | 5/2000 |
| CN | 1337042 | 2/2002 |

(Continued)

OTHER PUBLICATIONS

"Corrected Notice of Allowance", U.S. Appl. No. 14/162,707, Sep. 3, 2014, 5 pages.

(Continued)

*Primary Examiner* — Martin Lerner
(74) *Attorney, Agent, or Firm* — Danielle Johnston-Holmes; Micky Minhas

(57) ABSTRACT

A method, system and program for decoding a speech signal. In some embodiments, the method comprises: receiving an encoded speech signal having quantization values; transforming the quantization values by adding simulated random-noise samples; and from the encoded speech signal, determining a parameter of the transformation that is usable to control the transformation of the quantization values.

20 Claims, 10 Drawing Sheets

(56) References Cited

U.S. PATENT DOCUMENTS

| | | | | |
|---|---|---|---|---|
| 5,253,269 | A | 10/1993 | Gerson et al. | |
| 5,327,250 | A | 7/1994 | Ikeda | |
| 5,357,252 | A | 10/1994 | Ledzius et al. | |
| 5,487,086 | A | 1/1996 | Bhaskar | |
| 5,548,680 | A * | 8/1996 | Cellario | 704/219 |
| 5,646,961 | A | 7/1997 | Shoham et al. | |
| 5,649,054 | A | 7/1997 | Oomen et al. | |
| 5,680,508 | A | 10/1997 | Liu | |
| 5,699,382 | A | 12/1997 | Shoham et al. | |
| 5,774,842 | A | 6/1998 | Nishio et al. | |
| 5,867,814 | A | 2/1999 | Yong | |
| 5,950,155 | A * | 9/1999 | Nishiguchi | 704/230 |
| 6,104,992 | A | 8/2000 | Gao et al. | |
| 6,122,608 | A | 9/2000 | McCree | |
| 6,173,257 | B1 | 1/2001 | Gao | |
| 6,188,980 | B1 | 2/2001 | Thyssen | |
| 6,260,010 | B1 | 7/2001 | Gao et al. | |
| 6,363,119 | B1 | 3/2002 | Oami | |
| 6,408,268 | B1 | 6/2002 | Tasaki | |
| 6,456,964 | B2 | 9/2002 | Manjunath et al. | |
| 6,470,309 | B1 | 10/2002 | McCree | |
| 6,493,665 | B1 | 12/2002 | Su et al. | |
| 6,502,069 | B1 | 12/2002 | Grill et al. | |
| 6,523,002 | B1 | 2/2003 | Gao et al. | |
| 6,574,593 | B1 | 6/2003 | Gao et al. | |
| 6,664,913 | B1 | 12/2003 | Craven et al. | |
| 6,751,587 | B2 | 6/2004 | Thyssen et al. | |
| 6,757,649 | B1 | 6/2004 | Gao et al. | |
| 6,757,654 | B1 | 6/2004 | Westerlund et al. | |
| 6,775,649 | B1 | 8/2004 | DeMartin | |
| 6,862,567 | B1 | 3/2005 | Gao | |
| 6,996,523 | B1 | 2/2006 | Bhaskar et al. | |
| 7,136,812 | B2 | 11/2006 | Manjunath et al. | |
| 7,143,032 | B2 * | 11/2006 | Chen | 704/228 |
| 7,149,683 | B2 | 12/2006 | Jelinek | |
| 7,151,802 | B1 | 12/2006 | Bessette et al. | |
| 7,171,355 | B1 | 1/2007 | Chen | |
| 7,252,803 | B2 | 8/2007 | Guthrie et al. | |
| 7,496,505 | B2 | 2/2009 | Manjunath et al. | |
| 7,505,594 | B2 | 3/2009 | Mauro | |
| 7,684,981 | B2 | 3/2010 | Thumpudi et al. | |
| 7,778,476 | B2 | 8/2010 | Alvarez et al. | |
| 7,869,993 | B2 | 1/2011 | Ojala | |
| 7,873,511 | B2 | 1/2011 | Herre et al. | |
| 8,036,887 | B2 | 10/2011 | Yasunaga et al. | |
| 8,069,040 | B2 | 11/2011 | Vos | |
| 8,078,474 | B2 | 12/2011 | Vos et al. | |
| 8,140,324 | B2 | 3/2012 | Vos et al. | |
| 8,244,526 | B2 | 8/2012 | Vos et al. | |
| 8,392,178 | B2 | 3/2013 | Vos | |
| 8,396,706 | B2 | 3/2013 | Vos | |
| 8,433,563 | B2 | 4/2013 | Vos | |
| 8,452,606 | B2 | 5/2013 | Vos | |
| 8,463,604 | B2 | 6/2013 | Vos | |
| 8,639,504 | B2 | 1/2014 | Vos | |
| 8,655,653 | B2 | 2/2014 | Vos | |
| 8,670,981 | B2 | 3/2014 | Vos et al. | |
| 8,682,652 | B2 | 3/2014 | Herre et al. | |
| 8,849,658 | B2 | 9/2014 | Vos | |
| 2001/0001320 | A1 | 5/2001 | Heinen et al. | |
| 2001/0005822 | A1 | 6/2001 | Fujii et al. | |
| 2001/0039491 | A1 | 11/2001 | Yasunaga et al. | |
| 2002/0032571 | A1 | 3/2002 | Leung et al. | |
| 2002/0049586 | A1 * | 4/2002 | Nishio et al. | 704/230 |
| 2002/0099540 | A1 | 7/2002 | Yasunaga et al. | |
| 2002/0120438 | A1 | 8/2002 | Lin | |
| 2002/0156625 | A1 * | 10/2002 | Thyssen | 704/229 |
| 2003/0135367 | A1 * | 7/2003 | Thyssen et al. | 704/230 |
| 2003/0200092 | A1 | 10/2003 | Gao et al. | |
| 2004/0102969 | A1 | 5/2004 | Manjunath et al. | |
| 2005/0007262 | A1 * | 1/2005 | Craven et al. | 341/50 |
| 2005/0141721 | A1 | 6/2005 | Aarts et al. | |
| 2005/0278169 | A1 | 12/2005 | Hardwick | |
| 2005/0285765 | A1 | 12/2005 | Suzuki et al. | |
| 2006/0074643 | A1 | 4/2006 | Lee et al. | |
| 2006/0235682 | A1 | 10/2006 | Yasunaga et al. | |
| 2006/0265216 | A1 * | 11/2006 | Chen | 704/228 |
| 2006/0271356 | A1 | 11/2006 | Vos | |
| 2006/0277039 | A1 | 12/2006 | Vos et al. | |
| 2006/0282262 | A1 | 12/2006 | Vos et al. | |
| 2007/0043560 | A1 | 2/2007 | Lee | |
| 2007/0055503 | A1 | 3/2007 | Chu et al. | |
| 2007/0064956 | A1 * | 3/2007 | Iwata | 381/61 |
| 2007/0088543 | A1 | 4/2007 | Ehara | |
| 2007/0100613 | A1 | 5/2007 | Yasunaga et al. | |
| 2007/0136057 | A1 | 6/2007 | Phillips | |
| 2007/0225971 | A1 | 9/2007 | Bessette | |
| 2007/0255561 | A1 | 11/2007 | Su et al. | |
| 2008/0004869 | A1 | 1/2008 | Herre et al. | |
| 2008/0015866 | A1 | 1/2008 | Thyssen et al. | |
| 2008/0091418 | A1 | 4/2008 | Laaksonen et al. | |
| 2008/0126084 | A1 | 5/2008 | Lee et al. | |
| 2008/0140426 | A1 | 6/2008 | Kim et al. | |
| 2008/0154588 | A1 | 6/2008 | Gao | |
| 2008/0275698 | A1 | 11/2008 | Yasunaga et al. | |
| 2009/0012781 | A1 | 1/2009 | Yasunaga et al. | |
| 2009/0043574 | A1 | 2/2009 | Gao et al. | |
| 2009/0222273 | A1 | 9/2009 | Massaloux et al. | |
| 2010/0174531 | A1 | 7/2010 | Bernard Vos | |
| 2010/0174532 | A1 | 7/2010 | Vos et al. | |
| 2010/0174534 | A1 | 7/2010 | Vos | |
| 2010/0174541 | A1 | 7/2010 | Vos | |
| 2010/0174542 | A1 | 7/2010 | Vos | |
| 2010/0174547 | A1 | 7/2010 | Vos | |
| 2011/0077940 | A1 | 3/2011 | Vos et al. | |
| 2011/0173004 | A1 | 7/2011 | Bessette et al. | |
| 2013/0262100 | A1 | 10/2013 | Vos | |
| 2014/0142936 | A1 | 5/2014 | Vos | |
| 2014/0358531 | A1 | 12/2014 | Vos | |

FOREIGN PATENT DOCUMENTS

| | | |
|---|---|---|
| CN | 1653521 | 8/2005 |
| EP | 0501421 | 9/1992 |
| EP | 0550990 | 7/1993 |
| EP | 0610906 | 8/1994 |
| EP | 0720145 | 7/1996 |
| EP | 0724252 | 7/1996 |
| EP | 0849724 | 6/1998 |
| EP | 0877355 | 11/1998 |
| EP | 0957472 | 11/1999 |
| EP | 1093116 | 4/2001 |
| EP | 1255244 | 11/2002 |
| EP | 1326235 | 7/2003 |
| EP | 1758101 | 2/2007 |
| EP | 1903558 | 3/2008 |
| GB | 2466669 | 7/2010 |
| GB | 2466670 | 7/2010 |
| GB | 2466671 | 7/2010 |
| GB | 2466672 | 7/2010 |
| GB | 2466673 | 7/2010 |
| GB | 2466674 | 7/2010 |
| GB | 2466675 | 7/2010 |
| JP | 1205638 | 10/1987 |
| JP | 2287400 | 4/1989 |
| JP | 4312000 | 4/1991 |
| JP | 7306699 | 5/1994 |
| JP | 2007279754 | 10/2007 |
| WO | WO-9103790 | 3/1991 |
| WO | WO-9403988 | 2/1994 |
| WO | WO-9518523 | 7/1995 |
| WO | WO-9918565 | 4/1999 |
| WO | WO-9963521 | 12/1999 |
| WO | WO-0103122 | 1/2001 |
| WO | WO-0191112 | 11/2001 |
| WO | WO-03052744 | 6/2003 |
| WO | WO-2005009019 | 1/2005 |
| WO | WO-2008046492 | 4/2008 |
| WO | WO-2008056775 | 5/2008 |
| WO | WO-2010079163 | 7/2010 |
| WO | WO-2010079164 | 7/2010 |
| WO | WO-2010079165 | 7/2010 |
| WO | WO-2010079166 | 7/2010 |

(56) References Cited

FOREIGN PATENT DOCUMENTS

| | | |
|---|---|---|
| WO | WO-2010079167 | 7/2010 |
| WO | WO-2010079170 | 7/2010 |
| WO | WO-2010079171 | 7/2010 |

OTHER PUBLICATIONS

"Foreign Notice of Allowance", EP Application No. 10700158.8, Jun. 3, 2014, 7 pages.
"Foreign Office Action", EP Application No. 10700158.8, Oct. 15, 2013, 4 pages.
"Foreign Notice of Allowance", CN Application No. 201080010209.6, Apr. 1, 2014, 3 pages.
"Notice of Allowance", U.S. Appl. No. 14/162,707, May 9, 2014, 6 pages.
"Coding of Speech at 8 kbit/s Using Conjugate-Structure Algebraic-Code-Excited Linear-Prediction (CS-ACELP)", International Telecommunication Union, ITUT, 1996, 39 pages.
"Examination Report under Section 18(3)", Great Britain Application No. 0900143.9, May 21, 2012, 2 pages.
"Examination Report", GB Application No. 0900139.7, Aug. 28, 2012, 1 page.
"Examination Report", GB Application No. 0900140.5, Aug. 29, 2012, 3 pages.
"Examination Report", GB Application No. 0900141.3, Oct. 8, 2012, 2 pages.
"Final Office Action", U.S. Appl. No. 12/455,100, Oct. 4, 2012, 5 pages.
"Final Office Action", U.S. Appl. No. 12/455,478, Jun. 28, 2012, 8 pages.
"Final Office Action", U.S. Appl. No. 12/455,632, Jan. 18, 2013, 15 pages.
"Final Office Action", U.S. Appl. No. 12/455,752, Nov. 23, 2012, 8 pages.
"Final Office Action", U.S. Appl. No. 12/583,998, May 20, 2013, 19 pages.
"Foreign Office Action", CN Application No. 201080010208.1, Dec. 28, 2012, 12 pages.
"Foreign Office Action", CN Application No. 201080010209, Jan. 30, 2013, 12 pages.
"International Search Report and Written Opinion", Application No. PCT/EP2010/050057, Jun. 24, 2010, 11 pages.
"International Search Report and Written Opinion", Application No. PCT/EP2010/050051, Mar. 15, 2010, 13 pages.
"International Search Report and Written Opinion", Application No. PCT/EP2010/050061, Apr. 12, 2010, 13 pages.
"International Search Report and Written Opinion", Application No. PCT/EP2010/050052, Jun. 21, 2010, 13 pages.
"International Search Report and Written Opinion", Application No. PCT/EP2010/050060, Apr. 14, 2010, 14 pages.
"International Search Report and Written Opinion", Application No. PCT/EP2010/050053, May 17, 2010, 17 pages.
"Non-Final Office Action", U.S. Appl. No. 12/455,100, Jun. 8, 2012, 8 pages.
"Non-Final Office Action", U.S. Appl. No. 12/455,157, Aug. 6, 2012, 15 pages.
"Non-Final Office Action", U.S. Appl. No. 12/455,632, Jun. 4, 2013, 13 pages.
"Non-Final Office Action", U.S. Appl. No. 12/455,632, Oct. 18, 2011, 14 pages.
"Non-Final Office Action", U.S. Appl. No. 12/455,632, Feb. 6, 2012, 18 pages.
"Non-Final Office Action", U.S. Appl. No. 12/455,632, Aug. 22, 2012, 14 pages.
"Non-Final Office Action", U.S. Appl. No. 12/455,712, Jun. 20, 2012, 8 pages.
"Non-Final Office Action", U.S. Appl. No. 12/455,752, Jun. 15, 2012, 8 pages.
"Non-Final Office Action", U.S. Appl. No. 12/583,998, Oct. 18, 2012, 16 pages.
"Non-Final Office Action", U.S. Appl. No. 12/586,915, May 8, 2012, 10 pages.
"Non-Final Office Action", U.S. Appl. No. 12/586,915, Sep. 25, 2012, 10 pages.
"Non-Final Office Action", U.S. Appl. No. 13/905,864, Aug. 15, 2013, 6 pages.
"Notice of Allowance", U.S. Appl. No. 12/455,100, Feb. 5, 2013, 4 Pages.
"Notice of Allowance", U.S. Appl. No. 12/455,157, Nov. 29, 2012, 9 pages.
"Notice of Allowance", U.S. Appl. No. 12/455,478, Dec. 7, 2012, 7 pages.
"Notice of Allowance", U.S. Appl. No. 12/455,632, Oct. 9, 2013, 8 pages.
"Notice of Allowance", U.S. Appl. No. 12/455,632, May 15, 2012, 7 pages.
"Notice of Allowance", U.S. Appl. No. 12/455,712, Oct. 23, 2012, 7 pages.
"Notice of Allowance", U.S. Appl. No. 12/455,752, Oct. 4, 2013, 6 pages.
"Notice of Allowance", U.S. Appl. No. 12/586,915, Jan. 22, 2013, 8 pages.
"Notice of Allowance", U.S. Appl. No. 13/905,864, Sep. 17, 2013, 5 pages.
"Search Report", Application No. GB0900139.7, Apr. 17, 2009, 3 pages.
"Search Report", Application No. GB0900141.3, Apr. 30, 2009, 3 pages.
"Search Report", Application No. GB0900142.1, Apr. 21, 2009, 2 pages.
"Search Report", Application No. GB0900144.7, Apr. 24, 2009, 2 pages.
"Search Report", Application No. GB0900143.9, Apr. 28, 2009, 1 page.
"Search Report", Application No. GB0900140.5, May 5, 2009, 3 pages.
"Supplemental Notice of Allowance", U.S. Appl. No. 12/455,100, Apr. 4, 2013, 2 pages.
"Supplemental Notice of Allowance", U.S. Appl. No. 12/455,100, May 16, 2013, 2 pages.
"Supplemental Notice of Allowance", U.S. Appl. No. 12/455,157, Jan. 22, 2013, 2 pages.
"Supplemental Notice of Allowance", U.S. Appl. No. 12/455,157, Feb. 8, 2013, 2 pages.
"Supplemental Notice of Allowance", U.S. Appl. No. 12/455,478, Jan. 11, 2013, 2 pages.
"Supplemental Notice of Allowance", U.S. Appl. No. 12/455,478, Mar. 28, 2013, 3 pages.
"Supplemental Notice of Allowance", U.S. Appl. No. 12/455,632, Jan. 22, 2014, 4 pages.
"Supplemental Notice of Allowance", U.S. Appl. No. 12/455,712, Jan. 14, 2013, 2 pages.
"Supplemental Notice of Allowance", U.S. Appl. No. 12/455,712, Feb. 5, 2013, 2 pages.
"Supplemental Notice of Allowance", U.S. Appl. No. 12/455,712, Dec. 19, 2012, 2 pages.
"Supplemental Notice of Allowance", U.S. Appl. No. 12/455,752, Jan. 30, 2014, 2 pages.
"Supplemental Notice of Allowance", U.S. Appl. No. 12/455,752, Dec. 16, 2013, 2 pages.
"Supplemental Notice of Allowance", U.S. Appl. No. 13/905,864, Jan. 3, 2014, 2 pages.
"Wideband Coding of Speech at Around 1 kbit/sUsing Adaptive Multi-rate Wideband (AMR-WB)", International Telecommunication Union G.722.2, 2002, pp. 1-65.
Atal, et al., "Predictive Coding of Speech Signals and Error Criteria", IEEE, Transactions on Acoustics, Speech and Signal Processing, ASSP 27(3), 1979, pp. 247-254.
Chen, "Novel Codec Structures for Noise Feedback Coding of Speech", IEEE, 2006, pp. 681-684.
Chen, "Subframe Interpolation Optimized Coding of LSF Parameters", IEEE, Jul. 2007, pp. 725-728.

(56) References Cited

OTHER PUBLICATIONS

Denckla, "Subtractive Dither for Internet Audio", Journal of the Audio Engineering Society, vol. 46, Issue 7/8, Jul. 1998, pp. 654-656.
Ferreira, et al., "Modified Interpolation of LSFs Based on Optimization of Distortion Measures", IEEE, Sep. 2006, pp. 777-782.
Gerzon, et al., "A High-Rate Buried-Data Channel for Audio CD", Journal of Audio Engineering Society, vol. 43, No. 1/2,Jan. 1995, 22 pages.
Haagen, et al., "Improvements in 2.4 KBPS High-Quality Speech Coding", IEEE, Mar. 1992, pp. 145-148.
Islam, et al., "Partial-Energy Weighted Interpolation of Linear Prediction Coefficients", IEEE, Sep. 2000, pp. 105-107.
Jayant, et al., "The Application of Dither to the Quantization of Speech Signals", Program of the 84th Meeting of the Acoustical Society of America. (Abstract Only), Nov.-Dec. 1972, pp. 1293-1304.
Lupini, et al., "A Multi-Mode Variable Rate Celp Coder Based on Frame Classification", Proceedings of the International Conference on Communications (ICC), IEEE 1, 1993, pp. 406-409.
Mahe, et al., "Quantization Noise Spectral Shaping in Instantaneous Coding of Spectrally Unbalanced Speech Signals", IEEE, Speech Coding Workshop, 2002, pp. 56-58.
Makhoul, et al., "Adaptive Noise Spectral Shaping and Entropy Coding of Speech", Feb. 1979, pp. 63-73.
Martins et al., "Interpolation-Based Differential Vector Coding of Speech LSF Parameters", IEEE, Nov. 1996, pp. 2049-2052.
Rao, et al., "Pitch Adaptive Windows for Improved Excitation Coding in Low-Rate CELP Coders", IEEE Transactions on Speech and Audio Processing, Nov. 2003, pp. 648-659.
Salami, "Design and Description of CS-ACELP: A Toll Quality 8 kb/s Speech Coder", IEEE, 6(2), Mar. 1998, pp. 116-130.
"Foreign Office Action", GB Application No. 0900145.4, May 28, 2012, 2 pages.
"International Search Report and Written Opinion", Application No. PCT/EP2010/050056, Mar. 29, 2010, 8 pages.
"Non-Final Office Action", U.S. Appl. No. 12/583,998, Nov. 10, 2014, 20 pages.
"Non-Final Office Action", U.S. Appl. No. 14/459,984, Oct. 28, 2014, 4 pages.
"Search Report", Application No. GB0900145.4, Apr. 27, 2009, 1 page.
"Final Office Action", U.S. Appl. No. 12/583,998, May 28, 2015, 19 pages.
"Final Office Action", U.S. Appl. No. 14/459,984, May 1, 2015, 5 pages.
"Foreign Notice of Allowance", EP Application No. 10700157.0, Oct. 17, 2014, 6 pages.
"Foreign Office Action", EP Application No. 10700157.0, Oct. 15, 2013, 5 pages.
"Summons to Attend Oral Proceedings", EP Application No. 10700157.0, May 30, 2014, 6 pages.
"Non-Final Office Action", U.S. Appl. No. 14/459,984, Sep. 29, 2015, 5 pages.

* cited by examiner

SPEECH CODING BY QUANTIZING WITH RANDOM-NOISE SIGNAL

RELATED APPLICATION

This application is a continuation of and claims priority to U.S. patent application Ser. No. 12/455,632 filed Jun. 4, 2009 (now U.S. Pat. No. 8,655,653, issued Feb. 18, 2014). 12/455,632 claims priority under 35 USC §119 or §365 to Great Britain Patent Application No. 0900145.4, filed Jan. 6, 2009 by Koen Bernard Vos, the disclosure of which is incorporate in its entirety.

BACKGROUND

A source-filter model of speech is illustrated schematically in FIG. 1*a*. As shown, speech can be modelled as comprising a signal from a source 102 passed through a time-varying filter 104. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal, with each period corresponding to a respective "pitch pulse" comprising a series of peaks of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 202 is shown schematically in FIG. 2*a* with a gradually varying period $P_1$, $P_2$, $P_3$, etc., each comprising a pitch pulse of four peaks which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*. The short-term filter works by removing short-term correlations (i.e. short term compared to the pitch period), leading to an LPC residual with less energy than the speech signal.

The spectral envelope signal and the source signal are each encoded separately for transmission. In the illustrated example, each subframe 106 would contain: (i) a set of parameters representing the spectral envelope 204; and (ii) an LPC residual signal representing the source signal 202 with the effect of the short-term correlations removed.

To improve the encoding of the source signal, its periodicity may be exploited. To do this, a long-term prediction (LTP) analysis is used to determine the correlation of the LPC residual signal with itself from one period to the next, i.e. the correlation between the LPC residual signal at the current time and the LPC residual signal after one period at the current pitch lag (correlation being a statistical measure of a degree of relationship between groups of data, in this case the degree of repetition between portions of a signal). In this context the source signal can be said to be "quasi" periodic in that on a timescale of at least one correlation calculation it can be taken to have a meaningful period which is approximately (but not exactly) constant; but over many such calculations then the period and form of the source signal may change more significantly. A set of parameters derived from this correlation are determined to at least partially represent the source signal for each subframe. The set of parameters for each subframe is typically a set of coefficients C of a series, which form a respective vector $C_{LTP}=(C_1, C_2, \ldots C_i)$.

The effect of this inter-period correlation is then removed from the LPC residual, leaving an LTP residual signal representing the source signal with the effect of the correlation between pitch periods removed. To represent the source signal, the LTP vectors and LTP residual signal are encoded separately for transmission.

The sets of LPC parameters, the LTP vectors and the LTP residual signal are each quantised prior to transmission (quantisation being the process of converting a continuous range of values into a set of discrete values, or a larger approximately continuous set of discrete values into a smaller set of discrete values). The advantage of separating out the LPC residual signal into the LTP vectors and LTP residual signal is that the LTP residual typically has a lower energy than the LPC residual, and so requires fewer bits to quantize.

So in the illustrated example, each subframe 106 would comprise: (i) a quantised set of LPC parameters representing the spectral envelope, (ii)(a) a quantised LTP vector related to the correlation between pitch periods in the source signal, and (ii)(b) a quantised LTP residual signal representative of the source signal with the effects of this inter-period correlation removed.

In contrast with voiced sounds, for unvoiced sounds such as plosives (e.g. "T" or "P" sounds) the modelled source signal has no substantial degree of periodicity. In that case, long-term prediction (LTP) cannot be used and the LPC residual signal representing the modelled source signal is instead encoded differently, e.g. by being quantized directly.

FIG. 3*a* shows a diagram of a linear predictive speech encoder 300 comprising an LPC synthesis filter 306 having a short-term predictor 308 and an LTP synthesis filter 304 having a long-term predictor 310. The output of the short-term predictor 308 is subtracted from the speech input signal to produce an LPC residual signal. The output of the long-term predictor 310 is subtracted from the LPC residual signal to create an LTP residual signal. The LTP residual signal is quantized by a quantizer 302 to produce an excitation signal, and to produce corresponding quantisation indices for transmission to a decoder to allow it to recreate the excitation signal. The quantizer 302 can be a scalar quantizer, a trellis quantizer, a vector quantizer, an algebraic codebook quantizer, or any other suitable quantizer. The output of a long term predictor 310 in the LTP synthesis filter 304 is added to the excitation signal, which creates the LPC excitation signal. The LPC excitation signal is input to the long-term predictor 310, which is a strictly causal moving average (MA) filter controlled by the pitch lag and quantized LTP coefficients. The output of a short term predictor 308 in the LPC synthesis filter 306 is added to the LPC excitation signal, which creates the quantized output signal for feedback for subtraction of the input. The quantized output signal is input to the short-term predictor 308, which is a strictly causal MA filter controlled by the quantized LPC coefficients.

FIG. 3*b* shows a linear predictive speech decoder 350. Quantization indices are input to an excitation generator 352 which generates an excitation signal. The output of a long term predictor 360 in a LTP synthesis filter 354 is added to the excitation signal, which creates the LPC excitation signal. The LPC excitation signal is input to the long-term predictor 360, which is a strictly causal MA filter controlled by the pitch lag and quantized LTP coefficients. The output of a short term predictor 358 in a short-term synthesis filter 356 is added to the LPC excitation signal, which creates the quantized output signal. The quantized output signal is input to the short-term predictor 358, which is a strictly causal MA filter controlled by the quantized LPC coefficients.

The encoder 300 works by using an LPC analysis (not shown) to determine a short-term correlation in recently received samples of the speech signal, then passing coefficients of that correlation to the LPC synthesis filter 306 to predict following samples. The predicted samples are fed back to the input where they are subtracted from the speech signal, thus removing the effect of the spectral envelope and thereby deriving an LTP residual signal representing the modelled source of the speech. In the case of voiced frames, the encoder 300 also uses an LTP analysis (not shown) to determine a correlation between successive received pitch pulses in the LPC residual signal, then passes coefficients of that correlation to the LTP synthesis filter 304 where they are used to generate a predicted version of the later of those pitch pulses from the last stored one of the preceding pitch pulses. The predicted pitch pulse is fed back to the input where it is subtracted from the corresponding portion of the actual LPC residual signal, thus removing the effect of the periodicity and thereby deriving an LTP residual signal. Put another way, the LTP synthesis filter uses a long-term prediction to effectively remove or reduce the pitch pulses from the LPC residual signal, leaving an LTP residual signal having lower energy than the LPC residual.

An aim of the above techniques is to recreate more natural sounding speech without incurring the bitrate that would be required to directly represent the waveform of the immediate speech signal. However, a certain perceived coarseness in the sound quality of the speech can still be caused due to the quantization, e.g. of the quantised LTP residual in the case of voiced sounds or the quantized LPC residual in the case of unvoiced sounds. It would be desirable to find a way of reducing this quantization distortion without incurring undue bitrate in the encoded signal, i.e. to improve the rate-distortion performance.

SUMMARY

According to one or more embodiments, there is provided a method of encoding a speech signal, the method comprising: generating a first signal representing a property of an input speech signal; transforming the first signal using a simulated random-noise signal, thus producing a second signal; quantizing the second signal based on a plurality of discrete representation levels, thus generating quantization values for transmission in an encoded speech signal, and also generating a third signal being a quantized version of the second signal; performing an inverse of said transformation on the third signal, thus generating a quantized output signal, wherein the generation of said first signal is based on feedback of the quantized output signal; and transmitting said quantization values in the encoded speech signal over a transmission medium; wherein the method further comprises controlling said transformation in dependence on a property of the first signal so as to vary the magnitude of a noise effect created by the transformation relative to said representation levels.

In embodiments, said method may be a method of encoding speech according to a source-filter model whereby the speech signal is modelled to comprise a source signal filtered by a time-varying filter; and the varying of said magnitude may be dependent on whether the first signal is representative of: a property of a voiced interval of the modelled source signal having greater than a specified correlation between portions thereof, or a property of an unvoiced interval of the modelled source signal having less than a specified correlation between portions thereof.

If voiced, the varying of said magnitude may be based on a correlation between said portions of the modelled source signal.

If unvoiced, the varying of said magnitude may be based on a measure of sparseness of the modelled source signal.

The simulated random-noise signal may be generated based on said quantization values.

Said simulated random-noise signal may comprise a pseudorandom noise signal.

The method may comprise generating the pseudorandom noise signal using a seed based on said quantisation values.

Said transformation may comprise subtracting the simulated random-noise signal from the received first signal, the inverse transformation may comprises adding said simulated random-noise signal to the third signal, and said control of the transformation so as to vary the magnitude of said noise effect may comprise varying the magnitude of the simulated random-noise signal relative to said representation levels in dependence on a property of the first signal.

The simulated random-noise signal may have an associated energy, and said varying of the magnitude of the simulated random-noise signal relative to said representation levels may comprise varying the energy of the simulated random-noise signal.

Said varying of the magnitude of said noise effect relative to said representation levels may comprise varying the representation levels.

The generation of the first signal may be based on comparison of said speech signal with the quantized output signal.

The generation of the first signal based on said comparison may comprise: supplying the quantized output signal to a noise shaping filter, and applying an output of the shaping filter to the speech signal.

Said method may be a method of encoding speech according to a source-filter model whereby the speech signal is modelled to comprise a source signal filtered by a time-varying filter. The first signal may be representative of a property of the modelled source signal. Said generation of the first signal may comprise, based on the quantized output signal, removing an effect of the modelled filter from the speech signal. Said generation of the first signal may comprise, based on the quantized output signal, removing from said speech signal an effect of a degree of periodicity in the modelled source signal.

Said generation of the first signal based on the quantized output signal may comprise: supplying the quantized output signal to a short-term prediction filter, and generating said first signal by removing an output of the short-term prediction filter from said speech signal; and said generation of the quantized output signal may further comprise re-applying the output of the short-term prediction filter to said third signal.

Said generation of the first signal based on the quantized output signal may comprise: supplying the quantized output signal to a long-term prediction filter, and generating said first signal by removing an output of the long-term prediction filter from said speech signal; and said generation of the quantized output signal may further comprise re-applying the output of the long-term prediction filter to said third signal.

At least one embodiment provides a method of decoding an encoded speech signal, the method comprising: receiving an encoded speech signal; from the encoded speech signal, determining a first signal representing a property of speech; transforming the first signal using a simulated random-noise signal, thus producing a second signal; quantizing the second signal based on a plurality of discrete representation levels, thus generating a third signal being a quantized version of the second signal; performing an inverse of said transformation on the third signal, thus generating a quantized output signal; and supplying the quantized output signal in a decoded speech signal to an output device; wherein the method further comprises determining a parameter of said transformation from said encoded signal, and controlling said transformation in dependence on said parameter so as to vary the magnitude of a noise effect created by the transformation relative to said representation levels.

At least one embodiment provides an encoder for encoding a speech signal, the encoder comprising: an input module configured to generate a first signal representing a property of an input speech signal; a first transformation module configured to transform the first signal using a simulated random-noise signal, thus producing a second signal; a quantization unit configured to quantize the second signal based on a plurality of discrete representation levels, thus generating quantization values for transmission in an encoded speech signal, and also generating a third signal being a quantized version of the second signal; a second transformation module configured to perform an inverse of said transformation on the third signal, thus generating a quantized output signal, wherein the input module is configured to generate said first signal is based on feedback of the quantized output signal from the second transformation module; a transmitter configured to transmit said quantization values in the encoded speech signal over a transmission medium; a transform control module, operatively coupled to said transformation modules, configured to control said transformation in dependence on a property of the first signal so as to vary the magnitude of a noise effect created by the transformation relative to said representation levels.

At least one embodiment provides a decoder for decoding an encoded speech signal, the decoder comprising: an input module arranged to receive an encoded speech signal, and to determine from the encoded speech signal a first signal representing a property of speech; a first transformation module configured to transform the first signal using a simulated random-noise signal, thus producing a second signal; a quantization unit configured to quantize the second signal based on a plurality of discrete representation levels, thus generating a third signal being a quantized version of the second signal; a second transformation module configured to perform an inverse of said transformation on the third signal, thus generating a quantized output signal; and an output module configured to supply the quantized output signal in a decoded speech signal to an output device; wherein the input module is configured to determine a parameter of said transformation from said encoded signal, and encoder further comprises a transform control module configured to control said transformation in dependence on said parameter so as to vary the magnitude of a noise effect created by the transformation relative to said representation levels.

At least one embodiment provides a computer program product for encoding a speech signal, the program comprising code configured so as when executed on a processor to:

generate a first signal representing a property of an input speech signal;

transform the first signal using a simulated random-noise signal, thus producing a second signal;

quantize the second signal based on a plurality of discrete representation levels, thus generating quantization values for transmission in an encoded speech signal, and also generating a third signal being a quantized version of the second signal;

perform an inverse of said transformation on the third signal, thus generating a quantized output signal, wherein the generation of said first signal is based on feedback of the quantized output signal;

transmit said quantization values in the encoded speech signal over a transmission medium; and control said transformation in dependence on a property of the first signal so as to vary the magnitude of a noise effect created by the transformation relative to said representation levels.

At least one embodiment provides a computer program product for decoding an encoded speech signal, the program comprising code configured so as when executed on a processor to:

receive an encoded speech signal;

from the encoded speech signal, determine a first signal representing a property of speech;

transform the first signal using a simulated random-noise signal, thus producing a second signal;

quantize the second signal based on a plurality of discrete representation levels, thus generating a third signal being a quantized version of the second signal;

perform an inverse of said transformation on the third signal, thus generating a quantized output signal;

supply the quantized output signal in a decoded speech signal to an output device; and determine a parameter of said transformation from said encoded signal, and control said transformation in dependence on said parameter so as to vary the magnitude of a noise effect created by the transformation relative to said representation levels.

At least one embodiment provides corresponding computer program products such as client application products arranged so as when executed on a processor to perform the steps of the methods described above.

At least one embodiment provides a communication system comprising a plurality of end-user terminals each comprising a corresponding encoder and/or decoder.

BRIEF DESCRIPTION OF THE DRAWINGS

For a better understanding of one or more embodiments, reference will now be made by way of example to the accompanying drawings in which.

DETAILED DESCRIPTION

Figure 3A:
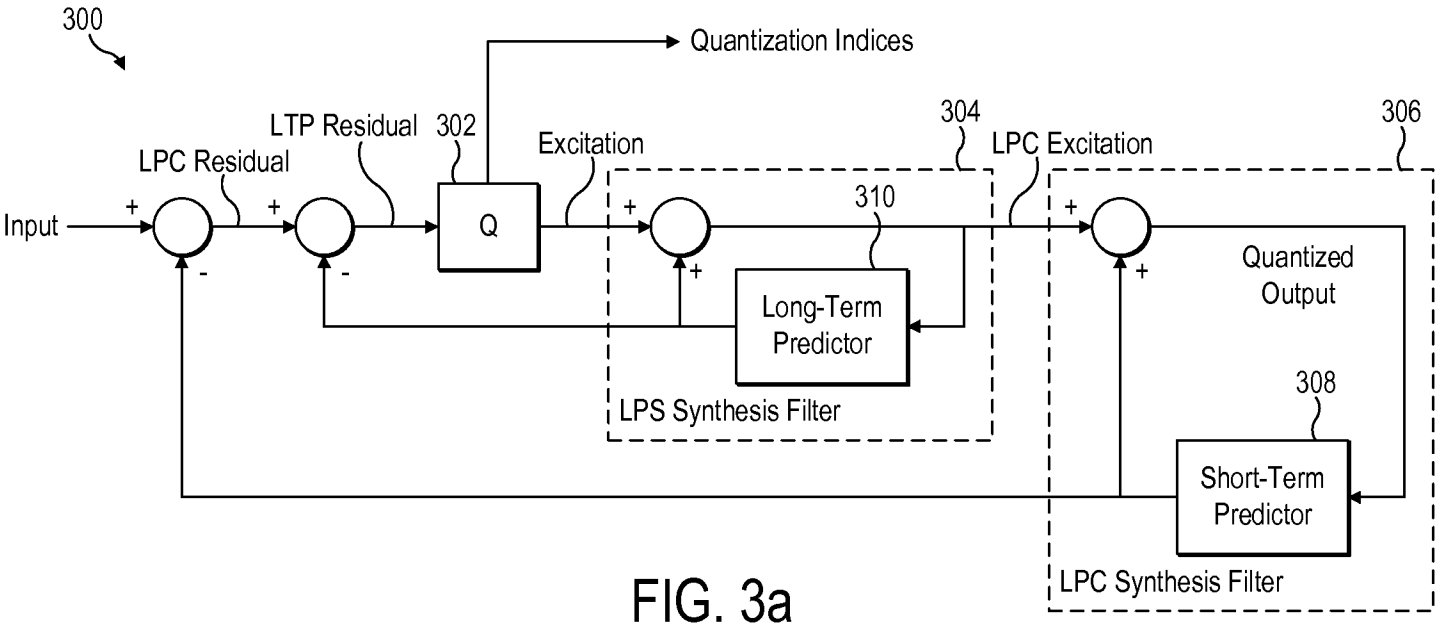
FIG. 3*a* is a schematic block diagram of an encoder.
Figure 3B:
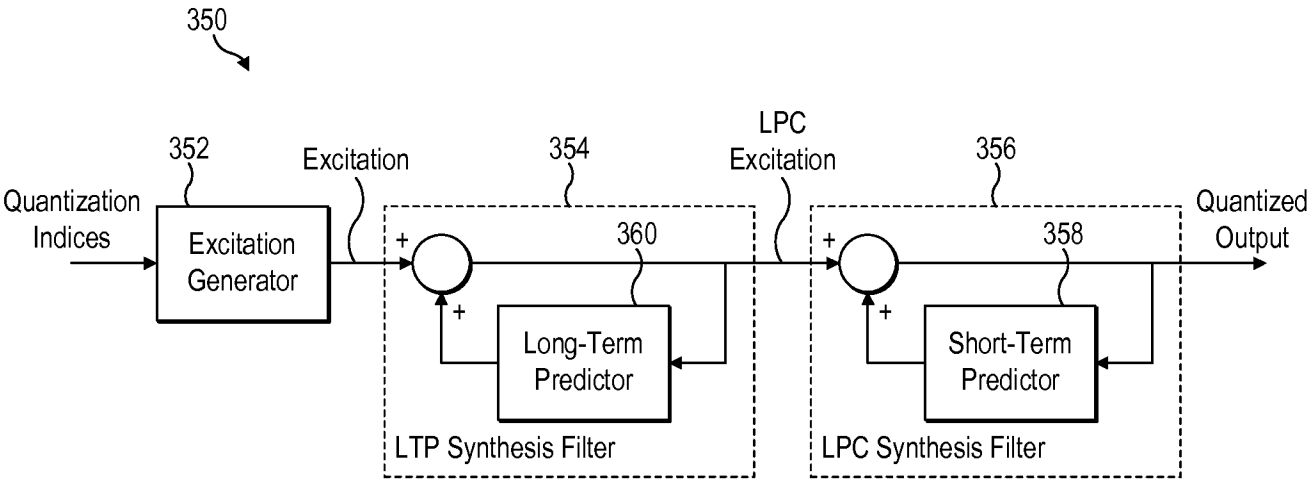
FIG. 3*b* is a schematic block diagram of a decoder.

Linear predictive coding is a common technique in speech coding, whereby correlations between samples are exploited to improve coding efficiency. For example, an encoder using this principle has already been described in relation to FIG. 3*a*. In such an encoder, the quantizer 302 may be a scalar quantizer.

Scalar quantization is a quantization method with low complexity and memory requirements. At bitrates up to about 1 bit/sample and under certain assumptions about the input signal, a uniform mid-tread (meaning that the representation levels include zero) quantizer provides rate-distortion performance near the theoretical performance bound for a scalar quantizer, provided the quantization indices are entropy coded. However, if such a configuration is used in a low bitrate predictive speech coder, the resulting signal has a coarse quality for noisy sounding input signals such a speech fricatives. The reason is that most of the samples of the quantized signal are zero, making for a sparse excitation signal.

One method to improve the sparseness problem, and thus reduce the coarseness of the sound quality, is to selectively run the quantized signal through an all-pass filter in the decoder for speech frames classified as being vulnerable to the coarseness problem. Unfortunately including an all-pass filter in the quantization process significantly reduces rate-distortion performance.

Figure 4A:
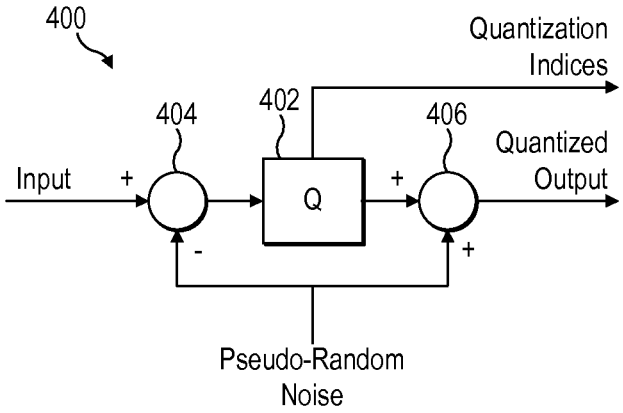
FIG. 4*a* is a schematic block diagram of a quantization module.

A better method is to use subtractive dithering, where a dither signal consisting of pseudo-random noise signal is subtracted before and added after quantization. In other words, the quantizer representation levels are effectively shifted by a pseudo-random noise signal. This is illustrated in FIG. 4*a*, which is a schematic block diagram of a quantization module 400, which could be used for example as the quantizer 302 of FIG. 3*a*. The quantization module 400 comprises a quantization unit 402 coupled between the output of a subtraction stage 404 and an input of an addition stage 406. The inputs of the subtraction stage 404 are arranged to receive an input signal and a pseudo-random noise signal respectively, and the other of the input of the addition stage 406 is also arranged to receive the same pseudo-random noise signal. The quantization unit 402 performs the actual quantization, and has an output arranged to provide quantization values for transmission in the encoded speech signal, typically in the form of quantization indices. The quantization unit 402 also has an output which is arranged to provide a quantized version of its input, that being the output coupled to the addition stage 406. The output of the addition stage 406 is arranged to provide the quantized output signal, e.g. for feedback to a short or long term synthesis filter 306 or 304. The pseudo-random noise signal is generated identically on encoder and decoder side. The energy in the pseudo-random noise signal sets a lower bound on the amount of noise in the quantized signal. For a large enough pseudo-random noise energy, the sparseness problem is entirely eliminated. However, a subtractive dithering quantizer gives a worse rate-distortion performance than a uniform mid-tread quantizer.

To overcome this problem, some embodiments provide a method of subtractive dithering with variable dither energy.

In some cases, this involves subtracting a pseudorandom noise signal from an input signal prior to quantization, and varying the energy in the pseudorandom noise signal. A pseudorandom noise signal is a signal that is not actually random but whose samples nonetheless satisfy some criterion for statistical randomness such as being uncorrelated. Thus the pseudorandom noise signal has the appearance of noise, but is in fact deterministic. The pseudorandom noise signal is generated using a seed, and a pseudorandom signal generated with a given algorithm using the same seed will always produce the same signal. Thus the pseudorandom signal is deterministic and can be recreated, but nonetheless has statistical properties of noise.

The energy in a signal is typically defined as an integral of signal intensity over time (i.e. an integral of the modulus squared of signal amplitude over time). However, the idea of varying the energy as described herein may refer to varying any property affecting the magnitude or "height" of the signal.

In at least one embodiment, the encoder selects an offset value that is multiplied by a pseudo-random sign and subtracted from the representation levels of the residual quantizer. The offset is taken into account when quantizing the prediction residual, and is indicated to the decoder, where it determines the perceived noisiness of the reconstructed speech. A higher offset leads to a noisier signal quality. The quality of decoded speech is improved by using a large offset for noisy-sounding input signals such as fricatives and a small offset for input signals that do not sound noisy, such as voiced speech with high periodicity or transients.

More generally however, one or more embodiments may be used to vary the energy of any simulated random-noise signal that is subtracted from an input signal representing some property of speech prior to quantization, then added back again after the quantization for feedback to generate that input signal.

Figure 4B:
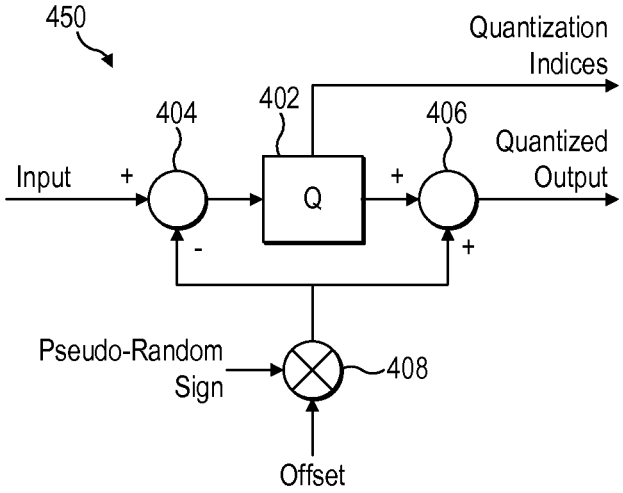
FIG. 4*b* is a schematic block diagram of another quantization module.

FIG. 4*b* shows an example of a quantization module 450 according to one or more embodiments, using subtractive dithering whereby the dither signal has a constant magnitude and pseudo-random sign. The offset value determines the lower limit on the amount of energy in the quantized output. This quantization module 450 could be used for example as the quantizer 302 of FIG. 3*a*, or in the noise shaping quantizer 516 of FIGS. 5 and 6 as discussed later.

As in the quantization module of FIG. 4*a*, the quantization module 450 of FIG. 4*b* comprises a quantization unit 402 coupled between the output of a subtraction stage 404 and an input of an addition stage 406. However, this quantization module 450 further comprises a multiplication stage 408 having inputs arranged to receive a pseudorandom noise signal and an offset value respectively. The output of the multiplication stage 408 is coupled to inputs of both the subtraction stage 404 and addition stage 406. The other input of the subtraction stage 404 is arranged to receive an input signal. The quantization unit 402 in some cases is a scalar quantizer. It performs the actual quantization, and has an output arranged to provide quantization values for transmission in the encoded speech signal, typically in the form of quantization indices. The quantization unit 402 also has an output which is arranged to provide a quantized version of its input, that being the output coupled to the addition stage 406. The output of the addition stage 406 is arranged to provide the quantized output signal, e.g. for feedback to a short or long term synthesis filter 306 or 304 as in FIG. 3*a* or prediction filter 614 as in FIG. 6, and/or to be compared with the input for use in a noise shaping filter 612 as in FIG. 6 (discussed later).

So in operation, the multiplication stage 408 receives a pseudorandom input signal and a variable offset value, and multiples them together to generate a pseudorandom noise signal with a variable energy. In some cases, the pseudorandom input signal is a signal having a constant magnitude and pseudorandom sign (i.e. pseudorandom distribution of positive and negative values). The multiplication stage 408 then supplied the generated pseudorandom noise signal to both the subtraction stage 404 and the addition stage 406. The subtraction stage receives an input signal representing some property of a speech signal (e.g. receives the LTP residual signal) and subtracts the pseudorandom noise signal. The output of the subtraction stage 404 is supplied to the input of the quantization unit 402, where it is quantized to produce quantization indices for use in the encoded speech signal to be transmitted to a decoder, and also to produce a quantized version of the input which is supplied to the addition stage 406. The addition stage 406 then adds the pseudorandom noise signal back on to the output of the quantization unit 402 to provide a quantized output signal and feeds it back for use in generating the future input signal. For example, the quantized output signal from the addition stage 406 may be fed back to a prediction filter and/or noise shaping filter.

Figure 4C:
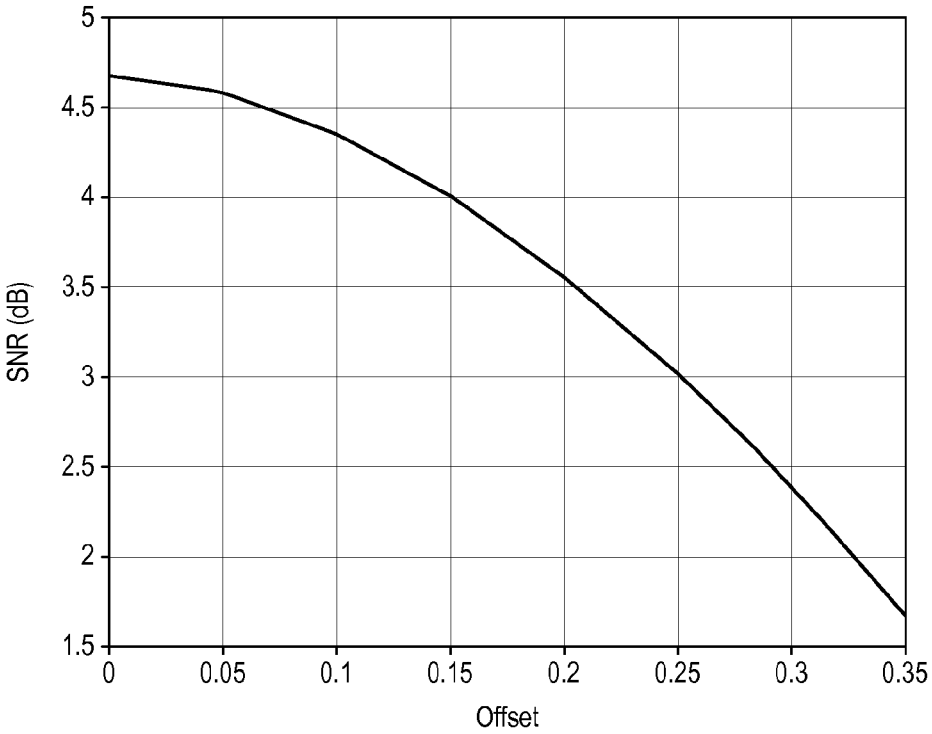
FIG. 4*c* is a graph of SNR for a subtractive dithering quantizer.

The rate-distortion performance becomes worse for increasing offset values. This is shown in the graph of FIG. 4*c*, where the signal-to-noise ratio of the quantized output signal relative to the input is shown for different offset values, when quantizing a white Gaussian noise signal at a bitrate of 1 bit per sample.

In some cases, it has been found empirically that an offset value of 0.25 eliminates the sparseness problem for fricatives (e.g. "F" or "Z" sounds). However, the rate-distortion performance for that offset values is about 1.7 dB worse than for an offset value of 0. Moreover, certain speech types other than fricatives, such as voiced speech and plosives, sound notably worse for an offset of 0.25 than for a lower offset value.

High-quality sound for all types of signal can be obtained by automatically classifying the input signal for vulnerability towards the sparseness problem and selecting an appropriate offset value. The offset value is transmitted to the decoder, so that the same dither signal can be generated in encoder and decoder.

Figure 1A:
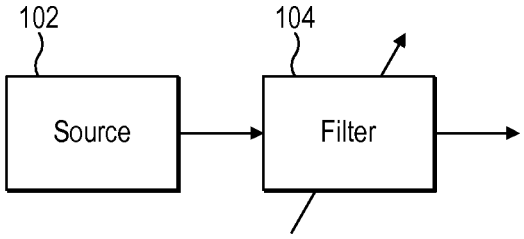
FIG. 1*a* is a schematic representation of a source-filter model of speech.
Figure 1B:
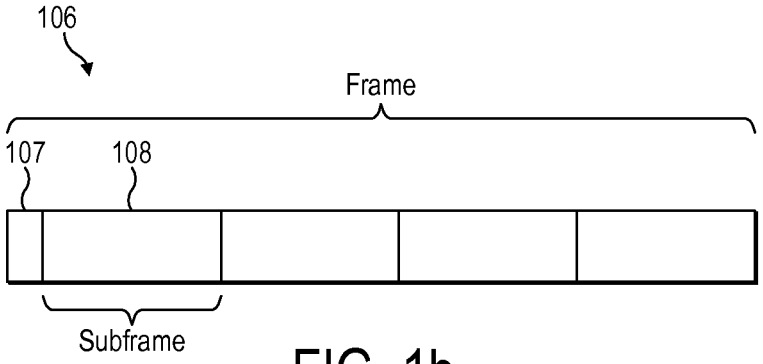
FIG. 1*b* is a schematic representation of a frame.
Figure 2A:
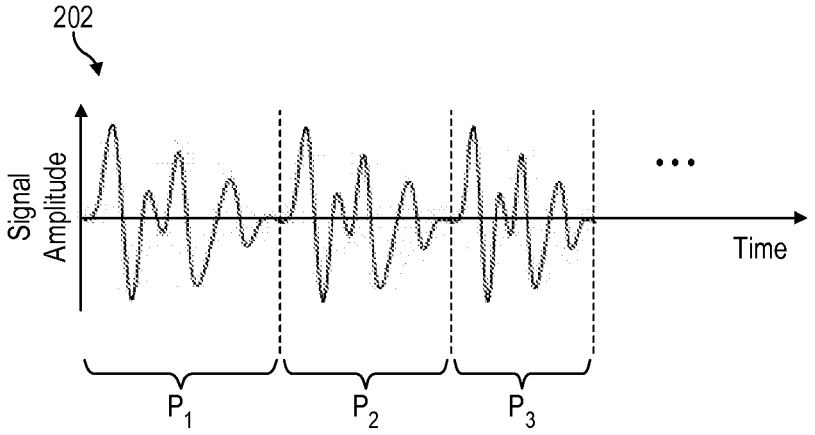
FIG. 2*a* is a schematic representation of a source signal.
Figure 2B:
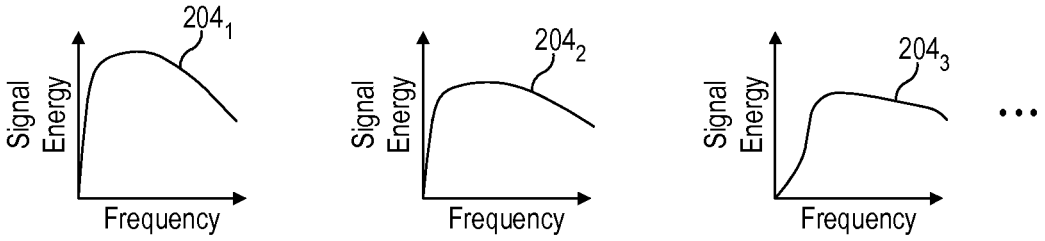
FIG. 2*b* is a schematic representation of variations in a spectral envelope.
Figure 4D:
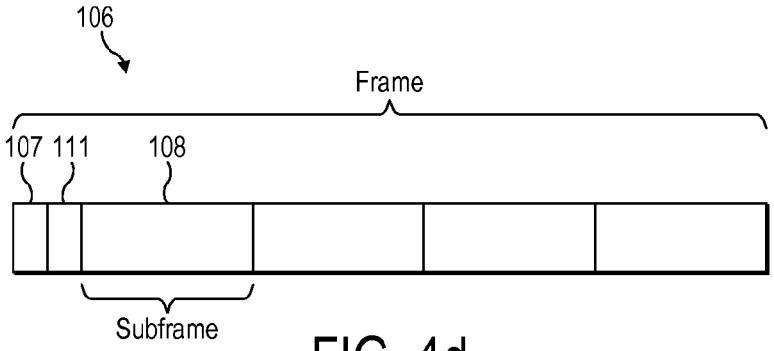
FIG. 4*d* is another schematic representation of a frame.

The selected offset is indicated in the encoded signal to the decoder, in some cases, once per frame. FIG. 4*d* is a schematic representation of a frame according to one or more embodiments. In addition to the classification flag 107 and subframes 108 as discussed in relation to FIG. 1*b*, the frame additionally comprises an indicator 111 of the offset selected to multiply with the pseudorandom input signal and thus control the energy in the generated pseudorandom noise signal.

Figure 5:
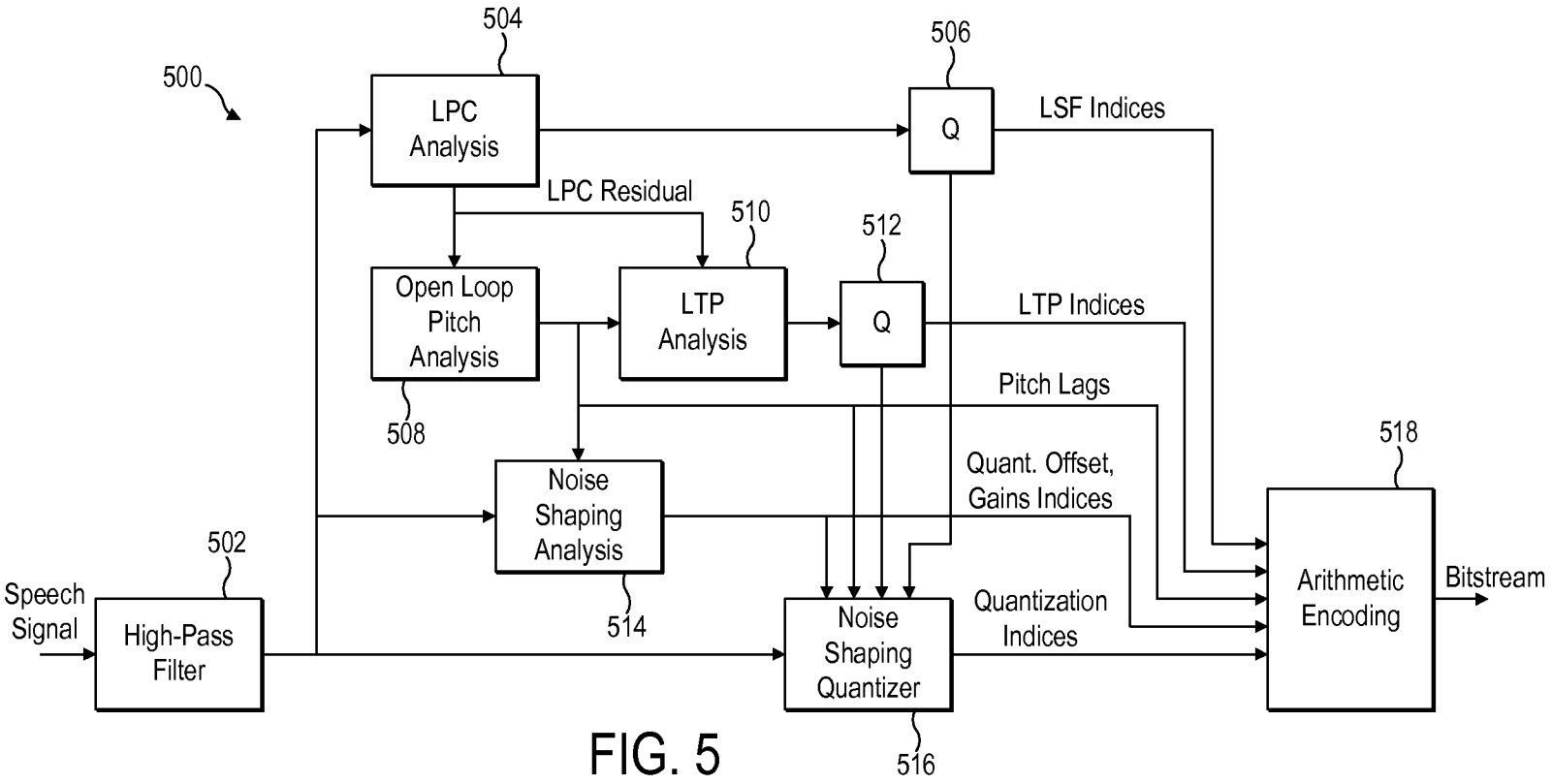
FIG. 5 is another schematic block diagram of an encoder.

An example of an encoder 500 for implementing one or more embodiments is now described in relation to FIG. 5.

The encoder 500 comprises a high-pass filter 502, a linear predictive coding (LPC) analysis block 504, a first vector quantizer 506, an open-loop pitch analysis block 508, a long-term prediction (LTP) analysis block 510, a second vector quantizer 512, a noise shaping analysis block 514, a noise shaping quantizer 516, and an arithmetic encoding block 518. The high pass filter 502 has an input arranged to receive an input speech signal from an input device such as a microphone, and an output coupled to inputs of the LPC analysis block 504, noise shaping analysis block 514 and noise shaping quantizer 516. The LPC analysis block has an output coupled to an input of the first vector quantizer 506, and the first vector quantizer 506 has outputs coupled to inputs of the arithmetic encoding block 518 and noise shaping quantizer 516. The LPC analysis block 504 has outputs coupled to inputs of the open-loop pitch analysis block 508 and the LTP analysis block 510. The LTP analysis block 510 has an output coupled to an input of the second vector quantizer 512, and the second vector quantizer 512 has outputs coupled to inputs of the arithmetic encoding block 518 and noise shaping quantizer 516. The open-loop pitch analysis block 508 has outputs coupled to inputs of the LTP 510 analysis block 510 and the noise shaping analysis block 514. The noise shaping analysis block 514 has outputs coupled to inputs of the arithmetic encoding block 518 and the noise shaping quantizer 516. The noise shaping quantizer 516 has an output coupled to an input of the arithmetic encoding block 518. The arithmetic encoding block 518 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes of 5 milliseconds. The output bitstream payload contains arithmetically encoded parameters, and has a bitrate that varies depending on a quality setting provided to the encoder and on the complexity and perceptual importance of the input signal.

The speech input signal is input to the high-pass filter 504 to remove frequencies below 80 Hz which contain almost no speech energy and may contain noise that can be detrimental to the coding efficiency and cause artifacts in the decoded output signal. At times, The high-pass filter 504 can be a second order auto-regressive moving average (ARMA) filter.

The high-pass filtered input $x_{HP}$ is input to the linear prediction coding (LPC) analysis block 504, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

The LPC coefficients are transformed to a line spectral frequency (LSF) vector. The LSFs are quantized using the first vector quantizer 506, a multi-stage vector quantizer (MSVQ) with 10 stages, producing 10 LSF indices that together represent the quantized LSFs. The quantized LSFs are transformed back to produce the quantized LPC coefficients for use in the noise shaping quantizer 516.

The LPC residual is input to the open loop pitch analysis block 508, producing one pitch lag for every 5 millisecond subframe, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 518 and noise shaping quantizer 516.

For voiced frames, a long-term prediction analysis is performed on the LPC residual. The LPC residual $r_{LPC}$ is supplied from the LPC analysis block 504 to the LTP analysis block 510. For each subframe, the LTP analysis block 510 solves normal equations to find 5 linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n - \text{lag} - i)b_i$$

is minimized. The normal equations are solved as:

$$b = W_{LTP}^{-1} C_{LTP},$$

where $W_{LTP}$ is a weighting matrix containing correlation values $$W_{LTP}(i, j) = \sum_{n=0}^{79} r_{LPC}(n + 2 - \text{lag} - i) r_{LPC}(n + 2 - \text{lag} - j),$$

and $C_{LTP}$ is a correlation vector:

$$C_{LTP}(i) = \sum_{n=0}^{79} r_{LPC}(n) r_{LPC}(n + 2 - \text{lag} - i).$$

Thus, the LTP residual is computed as the LPC residual in the current subframe minus a filtered and delayed LPC residual. The LPC residual in the current subframe and the delayed LPC residual are both generated with an LPC analysis filter controlled by the same LPC coefficients. That means that when the LPC coefficients were updated, an LPC residual is computed not only for the current frame but also a new LPC residual is computed for at least lag+2 samples preceding the current frame.

The LTP coefficients for each frame are quantized using a vector quantizer (VQ). The resulting VQ codebook index is input to the arithmetic coder, and the quantized LTP coefficients $b_Q$ are input to the noise shaping quantizer.

The high-pass filtered input is analyzed by the noise shaping analysis block 514 to find filter coefficients and quantization gains used in the noise shaping quantizer. The filter coefficients determine the distribution of the quantization noise over the spectrum, and are chose such that the quantization is least audible. The quantization gains determine the step size of the residual quantizer and as such govern the balance between bitrate and quantization noise level.

All noise shaping parameters are computed and applied per subframe of 5 milliseconds, except for the quantization offset which is determined once per frame of 20 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetic encoder 518. The quantized quantization gains are input to the noise shaping quantizer 516.

Next a set of short-term noise shaping coefficients $a_{shape,\,i}$ are found by applying bandwidth expansion to the coefficients found in the noise shaping LPC analysis. This bandwidth expansion moves the roots of the noise shaping LPC polynomial towards the origin, according to the formula:

$$a_{shape,i} = a_{autocorr,i} g^j$$

where $a_{autocorr,\,i}$ is the ith coefficient from the noise shaping LPC analysis and for the bandwidth expansion factor g a value of 0.94 was found to give good results.

For voiced frames, the noise shaping quantizer also applies long-term noise shaping. It uses three filter taps, described by:

$$b_{shape} = 0.5 \text{ sqrt(PitchCorrelation)}[0.25, 0.5, 0.25].$$

The short-term and long-term noise shaping coefficients are input to the noise shaping quantizer 516. The high-pass filtered input is also input to the noise shaping quantizer 516.

The noise shaping analysis block 514 computes a sparseness measure S from the LPC residual signal. First ten energies of the LPC residual signals in the current frame are determined, one energy per block of 2 milliseconds:

$$E(k) = \sum_{n=1}^{32} r_{LPC}(32k + n)^2.$$

Then the sparseness measure obtained as the absolute difference between logarithms of energies in consecutive blocks is added for the frame $$S = \sum_{k=1}^{9} \text{abs}(\log(E(k) - \log(E(k-1))).$$

In some embodiments, the noise shaping analysis block 514 determines a quantizer offset value. One of three different quantizer offset values, 0.05, 0.1 and 0.25, is selected. The selection depends on whether the frame is classified as voiced or unvoiced, on the pitch correlation value and on the sparseness measure. In some cases, the selection criteria can be expressed by the following pseudo-code:

```
If Voiced
    If PitchCorrelation > 0.8
        Offset = 0.05;
    Else
        Offset = 0.1;
    End
Else
    If Sparseness > 10
        Offset = 0.1;
    Else
```

-continued

```
            Offset = 0.25;
        End
    End
```

That is, for voiced frames the noise shaping analysis block 514 determines whether the pitch correlation for that frame is above a specified value, in this case 0.8. If so, it selects the offset for multiplying with the pseudorandom input signal to be a first value, e.g. 0.05; but if not, it selects the offset to be a second value, e.g. 0.1. For unvoiced frames on the other hand, the noise shaping analysis block 514 determines whether the sparseness measure S for that frame is greater than a specified value, in this case 10. If so, it selects the offset to be a third value, e.g. 0.1; but if not, it selects the offset to be a fourth value, e.g. 0.25.

Figure 6:
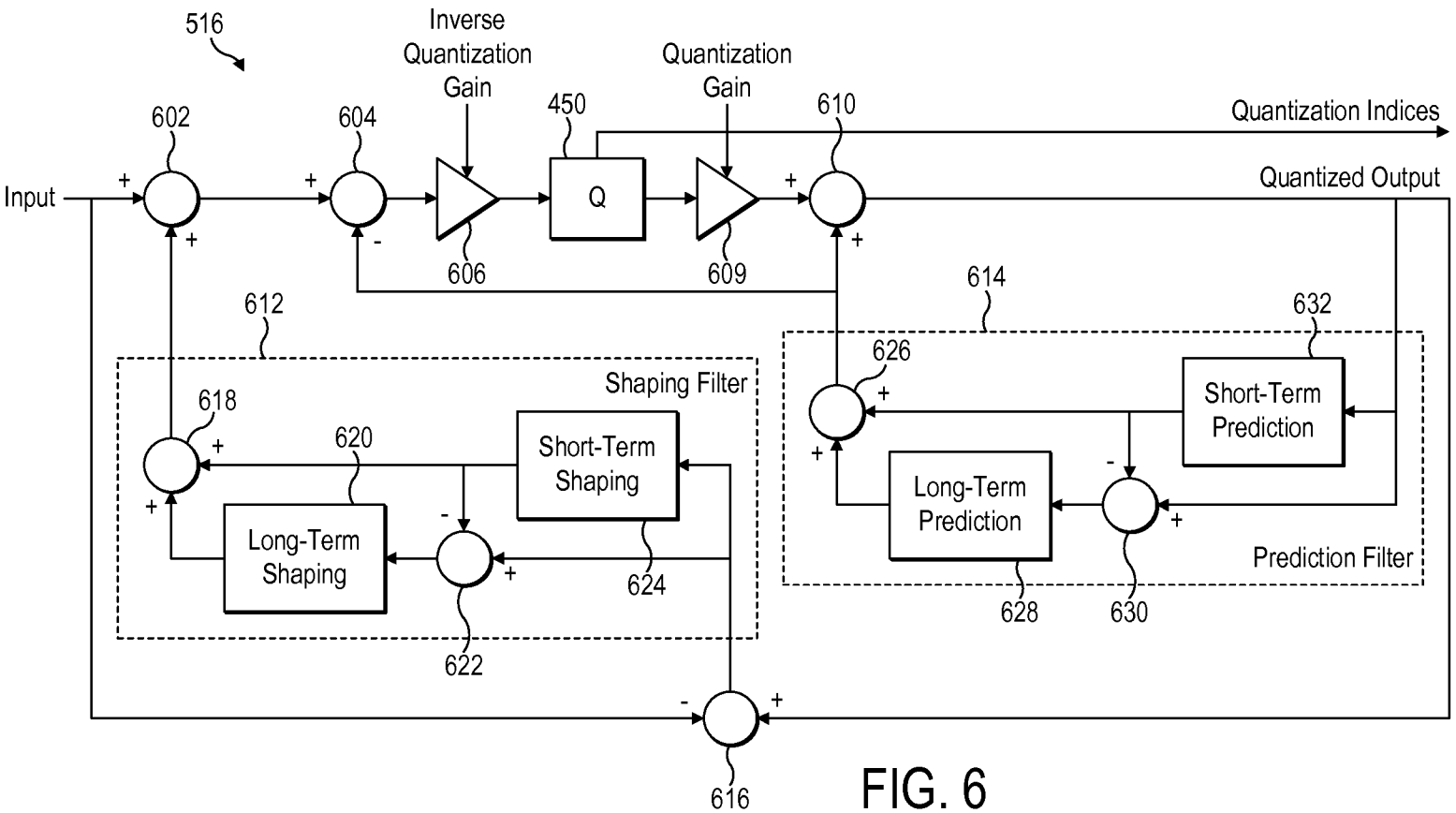
FIG. 6 is a schematic block diagram of a noise shaping quantizer.

The high-pass filtered input is input to the noise shaping quantizer 516, an example of which is now described in relation to FIG. 6. In some cases, the noise shaping quauntizer 516 uses a quantization module 450 as described in relation to FIG. 4.

The noise shaping quantizer 516 comprises a first addition stage 602, a first subtraction stage 604, a first amplifier 606, a scalar quantization module 450, a second amplifier 609, a second addition stage 610, a shaping filter 612, a prediction filter 614 and a second subtraction stage 616. The shaping filter 612 comprises a third addition stage 618, a long-term shaping block 620, a third subtraction stage 622, and a short-term shaping block 624. The prediction filter 614 comprises a fourth addition stage 626, a long-term prediction block 628, a fourth subtraction stage 630, and a short-term prediction block 632.

The first addition stage 602 has an input arranged to receive the high-pass filtered input from the high-pass filter 502, and another input coupled to an output of the third addition stage 618. The first subtraction stage has inputs coupled to outputs of the first addition stage 602 and fourth addition stage 626. The first amplifier has a signal input coupled to an output of the first subtraction stage and an output coupled to an input of the scalar quantizer 450. The first amplifier 606 also has a control input coupled to the output of the noise shaping analysis block 514. The scalar quantiser 450 has outputs coupled to inputs of the second amplifier 609 and the arithmetic encoding block 518. The second amplifier 609 also has a control input coupled to the output of the noise shaping analysis block 514, and an output coupled to the an input of the second addition stage 610. The other input of the second addition stage 610 is coupled to an output of the fourth addition stage 626. An output of the second addition stage is coupled back to the input of the first addition stage 602, and to an input of the short-term prediction block 632 and the fourth subtraction stage 630. An output of the short-term prediction block 632 is coupled to the other input of the fourth subtraction stage 630. The output of the fourth subtraction stage 630 is coupled to the input of the long-term prediction block 628. The fourth addition stage 626 has inputs coupled to outputs of the long-term prediction block 628 and short-term prediction block 632. The output of the second addition stage 610 is further coupled to an input of the second subtraction stage 616, and the other input of the second subtraction stage 616 is coupled to the input from the high-pass filter 502. An output of the second subtraction stage 616 is coupled to inputs of the short-term shaping block 624 and the third subtraction stage 622. An output of the short-term shaping block 624 is coupled to the other input of the third subtraction stage 622. The output of third subtraction stage 622 is coupled to the input of the long-term shaping block. The third addition stage 618 has inputs coupled to outputs of the long-term shaping block 620 and short-term prediction block 624. The short-term and long-term shaping blocks 624 and 620 are each also coupled to the noise shaping analysis block 514, and the long-term shaping block 620 is also coupled to the open-loop pitch analysis block 508 (connections not shown). Further, the short-term prediction block 632 is coupled to the LPC analysis block 504 via the first vector quantizer 506, and the long-term prediction block 628 is coupled to the LTP analysis block 510 via the second vector quantizer 512 (connections also not shown).

The purpose of the noise shaping quantizer 516 is to quantize the LTP residual signal in a manner that weights the distortion noise created by the quantisation into less noticeable parts of the frequency spectrum, e.g. where the human ear is more tolerant to noise and/or the speech energy is high so that the relative effect of the noise is less.

In operation, all gains and filter coefficients and gains are updated for every subframe, except for the LPC coefficients, which are updated once per frame. The noise shaping quantizer 516 generates a quantized output signal that is identical to the output signal ultimately generated in the decoder. The input signal is subtracted from this quantized output signal at the second subtraction stage 616 to obtain the quantization error signal d(n). The quantization error signal is input to a shaping filter 612, described in detail later. The output of the shaping filter 612 is added to the input signal at the first addition stage 602 in order to effect the spectral shaping of the quantization noise. From the resulting signal, the output of the prediction filter 614, described in detail below, is subtracted at the first subtraction stage 604 to create a residual signal.

The residual signal is multiplied at the first amplifier 606 by the inverse quantized quantization gain from the noise shaping analysis block 514, and input to the scalar quantization module 450. The quantization indices of the scalar quantization module 450 represent a signal that is input to the arithmetic encoder 518. The scalar quantization module 450 also outputs a quantization signal, which is multiplied at the second amplifier 609 by the quantized quantization gain from the noise shaping analysis block 514 to create an excitation signal.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is its output.

According to one or more described embodiments, the quantization module 450 uses the quantizer offset value from the noise shaping module to generate a dither signal. At the start of the frame, a pseudo-random generator is initialized with a seed. For each LTP residual sample, a pseudo-random noise sample is generated. Then the sign of the pseudo-random noise sample is multiplied by the quantizer offset value to create a dither sample. The LTP residual sample is multiplied by the inverse quantized quantization gain from the noise shaping analysis and the dither sample is subtracted to form the dithered quantizer input.

The quantization unit 402 of the quantization module 450 determines an excitation quantization index as follows. The absolute value of the dithered quantizer input is compared to a look-up table with increasing decision levels, and a table index is determined such that the absolute dithered quantizer input is at least equal to the decision level for that table index and smaller than the decision level for the table index increased by one. If the dithered quantizer input is negative, then the excitation quantization index is taken as the negative of the table index, otherwise the excitation quantization index is set equal to the table index.

To avoid having an identical dither signal for each frame, which would introduce an audible periodicity to the output signal, the quantization unit 402 of the quantization module 450 can, at times, increment the seed of the pseudo-random generator with the quantization index.

The signal of excitation quantization indices produced by the scalar quantization module 450 is input to the arithmetic encoder 518, along with an indication of the selected offset, for transmission in an encoded speech signal.

The subtractive dithering scalar quantization module 450 also outputs an excitation signal. The excitation signal is computed by, for each sample, adding the dither sample to the quantization index to form a quantization output sample. The quantization output samples for each subframe are multiplied by the quantized quantization gain from the noise shaping analysis to produce the excitation signal.

The output of the prediction filter 614 is added at the second addition stage to the excitation signal to form the quantized output signal y(n). The quantized output signal is input to the prediction filter 614.

The shaping filter 612 inputs the quantization error signal d(n) to a short-term shaping filter 624, which uses the short-term shaping coefficients $a_{shape}(i)$ to create a short-term shaping signal $s_{short}(n)$, according to the formula:

$$s_{short}(n) = \sum_{i=1}^{16} d(n-i)a_{shape}(i).$$

The short-term shaping signal is subtracted at the third addition stage 622 from the quantization error signal to create a shaping residual signal f(n). The shaping residual signal is input to a long-term shaping filter 620 which uses the long-term shaping coefficients $b_{shape}(i)$ to create a long-term shaping signal $s_{long}(n)$, according to the formula:

$$s_{long}(n) = \sum_{i=-2}^{2} f(n-\text{lag}-i)b_{shape}(i).$$

The short-term and long-term shaping signals are added together at the third addition stage 618 to create the shaping filter output signal.

The prediction filter 614 inputs the quantized output signal y(n) to a short-term prediction filter 632, which uses the quantized LPC coefficients $a_Q$ to create a short-term prediction signal $p_{short}(n)$, according to the formula:

$$p_{short}(n) = \sum_{i=1}^{16} y(n-i)a_Q(i).$$

The short-term prediction signal is subtracted at the fourth subtraction stage 630 from the quantized output signal to create an LPC excitation signal $e_{LPC}(n)$.

$$e_{LPC}(n) = y(n) - p_{short}(n) = y(n) - \sum_{i=1}^{16} y(n-i)a_Q(i)$$

The LPC excitation signal is input to a long-term prediction filter 628 which calculates a prediction signal using the filter coefficients that were derived from correlations in the LTP analysis block 510 (see FIG. 5). That is, long-term prediction filter 628 uses the quantized long-term prediction coefficients $b_Q(i)$ to create a long-term prediction signal $p_{long}(n)$, according to the formula:

$$p_{long}(n) = \sum_{i=-2}^{2} e_{LPC}(n-\text{lag}-i)b_Q(i).$$

The short-term and long-term prediction signals are added together to create the prediction filter output signal.

The LSF indices, LTP indices, quantization gains indices, pitch lags, LTP scaling value indices, and quantization indices, as well as the selected quantizer offset, are each arithmetically encoded and multiplexed to create the payload bitstream. The arithmetic encoder uses a look-up table with probability values for each index. The look-up tables are created by running a database of speech training signals and measuring frequencies of each of the index values. The frequencies are translated into probabilities through a normalization step.

Figure 7:
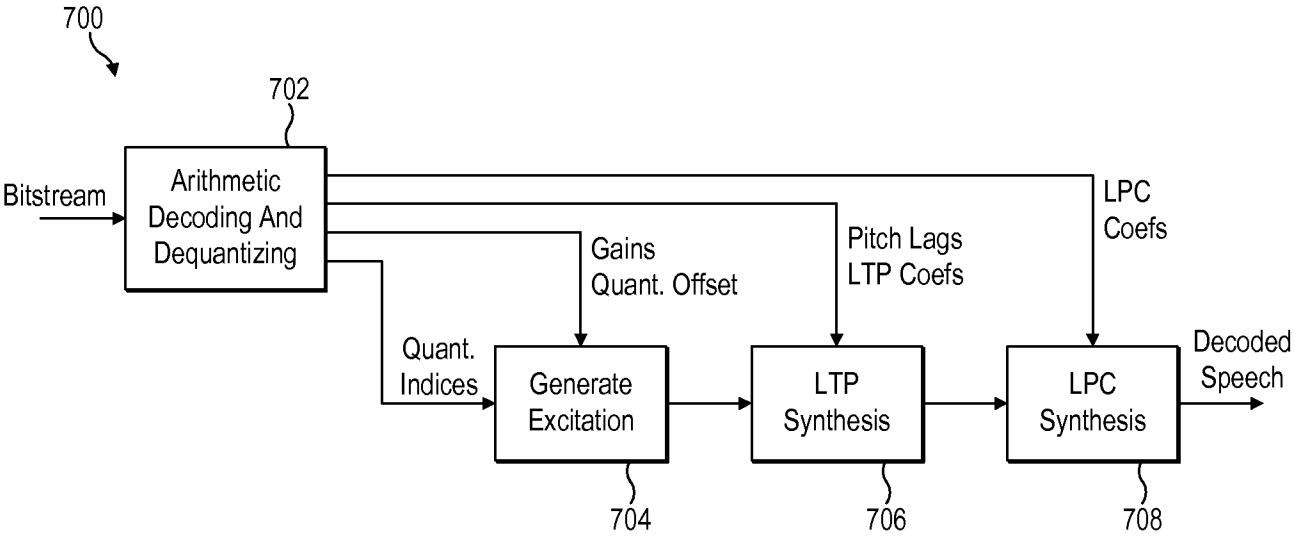
FIG. 7 is another schematic block diagram of a decoder.

An example decoder 700 for use in decoding a signal encoded according to one or more embodiments is now described in relation to FIG. 7.

The decoder 700 comprises an arithmetic decoding and dequantizing block 702, an excitation generator block 704, an LTP synthesis filter 706, and an LPC synthesis filter 708. The arithmetic decoding and dequantizing block 702 has an input arranged to receive an encoded bitstream from an input device such as a wired modem or wireless transceiver, and has outputs coupled to inputs of each of the excitation generator block 704, LTP synthesis filter 706 and LPC synthesis filter 708. The excitation generator block 704 has an output coupled to an input of the LTP synthesis filter 706, and the LTP synthesis block 706 has an output connected to an input of the LPC synthesis filter 708. The LPC synthesis filter has an output arranged to provide a decoded output for supply to an output device such as a speaker or headphones.

At the arithmetic decoding and dequantizing block 702, the arithmetically encoded bitstream is demultiplexed and decoded to create LSF indices, LTP indices, quantization gains indices, pitch lags and a signal of quantization indices, and also to determine the indicator 111 of the offset selected by the encoder 500. The LSF indices are converted to quantized LSFs by adding the codebook vectors of the ten stages of the MSVQ. The quantized LSFs are transformed to quantized LPC coefficients. The LTP codebook is then used to convert the LTP indices to quantized LTP coefficients. The gains indices are converted to quantization gains, through look ups in the gain quantization codebook.

In one or more embodiments, the excitation generator block 704 generates an excitation signal from the quantization indices. At the start of the frame, a pseudo-random generator is initialized with the same seed as in the encoder. For each quantization index, a dither sample is computed by generating a pseudo-random noise sample and multiplying the sign of the pseudo-random noise sample with the decoded offset value. The dither sample is added to the quantization index to form a quantization output sample. The dither samples are identical to the dither samples in the encoder used to quantize the LTP residual. The quantization output samples for each subframe are multiplied by the quantized quantization gain from the noise shaping analysis to produce the excitation signal.

At the excitation generation block, the excitation quantization indices signal is multiplied by the quantization gain to create an excitation signal e(n).

The excitation signal is input to the LTP synthesis filter 706 to create the LPC excitation signal $e_{LPC}(n)$ according to:

$$e_{LPC}(n) = e(n) + \sum_{i=-2}^{2} e(n - \text{lag} - i)b_Q(i),$$

using the pitch lag and quantized LTP coefficients $b_Q$.

The LPC excitation signal is input to an LPC synthesis filter to create the decoded speech signal y(n) according to $$y(n) = e_{LPC}(n) + \sum_{i=1}^{16} e_{LPC}(n - i)a_Q(i),$$

using the quantized LPC coefficients $a_Q$.

Figure 4E:
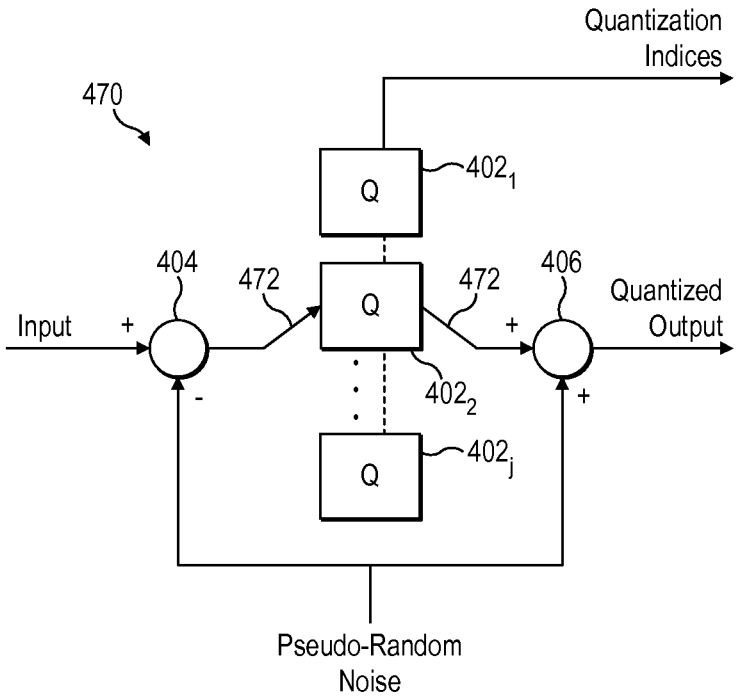
FIG. 4*e* is a schematic block diagram of another quantization module.

One or more embodiments are now described in relation to FIG. 4*e*, which shows a quantization module 470 that can be used as an alternative to the quantization module 450 of FIG. 4*b*. Here, there is no multiplication stage 408 to multiply a pseudorandom input signal by an offset value. Instead, a pseudorandom noise signal is input directly to the subtraction stage 404 and addition stage 406 as in FIG. 4*a*, but the quantization unit 402 is replaced by a plurality of quantization units $\mathbf{402}_1$, $\mathbf{402}_2$, . . . , $\mathbf{402}_j$ each switchably coupled by a switching stage 472 between the output of the subtraction stage 404 and an input of the addition stage 406. Each of the plurality of quantization units $\mathbf{402}_1$, $\mathbf{402}_2$, . . . , $\mathbf{402}_j$ has a different set of representation levels. The representation levels are the discrete set of levels by which the input signal can be represented once quantized.

Thus, instead of varying the offset, in this embodiment it is possible to vary the representation levels used in the quantization so that the pseudorandom noise signal is varied in magnitude relative to those representation levels. Either way has the result of shifting the effective representation levels by a pseudo-random noise signal.

In another alternative embodiment, a possibility would be to perform the following operations in the following order:

(a) multiply the input by a pseudo-random sign, (b) subtract an offset (with magnitude dependent on a speech property signal), (c) quantize, (d) add the offset to the quantizer output, and then (e) multiply the result by the pseudo-random sign.

The difference of this compared to the embodiment of FIG. 4*b* is that the signal, rather than the offset, is multiplied by the pseudo-random sign.

In yet another alternative embodiment, one of multiple quantizer units could be selected based on the pseudo-random noise signal and a speech property signal. In this case, no offset is subtracted or added explicitly. Rather, subtracting and adding an offset before and after quantization is replaced by selecting a quantizer with representation levels shifted by the offset.

In all of the above alternative embodiments, what matters is that for different speech signals, the quantization process generates noise with different minimum magnitude (or energy), relative to the representation levels.

The encoder 500 and decoder 700 can be implemented in software, such that each of the components 502 to 632 and 702 to 708 comprise modules of software stored on one or more memory devices and executed on a processor. Some embodiments encode speech for transmission over a packet-based network such as the Internet, such as a peer-to-peer (P2P) system implemented over the Internet, for example as part of a live call such as a Voice over IP (VoIP) call. In this case, the encoder 500 and decoder 700 can be implemented in client application software executed on end-user terminals of two users communicating over the P2P system.

It will be appreciated that the above embodiments are described only by way of example. For instance, some or all of the modules of the encoder and/or decoder could be implemented in dedicated hardware units. Further, various embodiments are not limited to use in a client application, but can be used for any other speech-related purpose such as cellular mobile telephony. Further, instead of a user input device like a microphone, the input speech signal could be received by the encoder from some other source such as a storage device and potentially be transcoded from some other form by the encoder; and/or instead of a user output device such as a speaker or headphones, the output signal from the decoder could be sent to another source such as a storage device and potentially be transcoded into some other form by the decoder. Other applications and configurations may be apparent to the person skilled in the art given the disclosure herein. It is to be appreciated and understood that the scope of the claimed subject matter is not limited by the described embodiments.

Some embodiments provide an encoder as described above having the following features.

The encoder may be for encoding speech according to a source-filter model whereby the speech signal is modelled to comprise a source signal filtered by a time-varying filter; and the transform control module may be configured to vary said magnitude in dependence on whether the first signal is representative of: a property of a voiced interval of the modelled source signal having greater than a specified correlation between portions thereof, or a property of an unvoiced interval of the modelled source signal having less than a specified correlation between portions thereof.

The transform control module may be configured such that, if voiced, the varying of said magnitude is based on a correlation between said portions of the modelled source signal.

The transform control module may be configured such that, if unvoiced, the varying of said magnitude is based on a measure of sparseness of the modelled source signal.

The encoder may comprise a noise simulator operatively coupled to the transformation modules and quantization unit, and configured to generate the simulated random-noise signal based on said quantization values.

The simulated random-noise signal may comprise a pseudorandom noise signal.

The noise simulator may be configured to generate the pseudorandom noise signal using a seed based on said quantisation values.

The first transformation module may comprise a subtraction stage configured to perform said transformation by subtracting the simulated random-noise signal from the received first signal, the second transformation module may comprise a subtraction stage configured to perform said inverse transformation by adding said simulated random-noise signal to the third signal, and said transform control module may be configured to perform said control of the transformation so as to vary the magnitude of said noise effect by varying the magnitude of the simulated random-noise signal relative to said representation levels in dependence on a property of the first signal.

The simulated random-noise signal may have an associated energy, and the transform control module may be configured to perform said varying of the magnitude of the simulated random-noise signal relative to said representation levels by varying the energy of the simulated random-noise signal.

The varying of the magnitude of said noise effect relative to said representation levels may comprise varying the representation levels.

The input module may be configured to generate the first signal based on comparison of said speech signal with the quantized output signal.

A noise shaping filter may be arranged to receive the quantized output signal, wherein the input module may be configured to generate the first signal based on said comparison by applying an output of the shaping filter to the speech signal.

The encoder may be for encoding speech according to a source-filter model whereby the speech signal is modelled to comprise a source signal filtered by a time-varying filter, and the first signal is representative of a property of the modelled source signal.

The encoder may be for encoding speech according to a source-filter model whereby the speech signal is modelled to comprise a source signal filtered by a time-varying filter; and the input module may be configured to generate the first signal by removing an effect of the modelled filter from the speech signal based on the quantized output signal.

The encoder may be for encoding speech according to a source-filter model whereby the speech signal is modelled to comprise a source signal filtered by a time-varying filter; and the input module may be configured to generate the first signal by, based on the quantized output signal, removing from said speech signal an effect of a degree of periodicity in the modelled source signal.

The encoder may comprise: a short-term prediction filter arranged to receive the quantized output signal, wherein the input module may be configured to generate the first signal based on the quantized output signal by removing an output of the short-term prediction filter from said speech signal; and a feedback module configured such that said generation of the quantized output signal further comprises re-applying the output of the short-term prediction filter to said third signal.

The encoder may comprise: a long-term prediction filter arranged to receive the quantized output signal, wherein the input module may be configured to generate the first signal based on the quantized output signal by removing an output of the long-term prediction filter from said speech signal; and a feedback module configured such that said generation of the quantized output signal further comprises re-applying the output of the long-term prediction filter to said third signal.

The invention claimed is:

1. A computer-implemented method of decoding an encoded speech signal comprising:

receiving, using at least one processor associated with the computer, an encoded speech signal having quantization values;

transforming, using at least one processor associated with the computer, the quantization values by adding simulated random-noise samples; and from the encoded speech signal, determining, using at least one processor associated with the computer, at least one parameter of the transformation that is usable to control the transformation of the quantization values, the at least one parameter comprising an offset value encoded in the encoded speech signal, the offset value comprising data used to generate a dither signal utilized in the transformation, the offset value based, at least in part, on a classification flag associated with the encoded speech signal.

2. The computer-implemented method as described in claim 1, wherein the encoded speech signal comprises a plurality of frames and the offset value is encoded in the encoded speech signal once per frame.

3. The computer-implemented method as described in claim 2, wherein each frame includes a respective classification flag configured to indicate whether the encoded speech signal in the associated frame comprises a voiced frame or unvoiced frame.

4. The computer-implemented method as described in claim 1 further comprising generating an output signal based, at least in part, on filtering a first signal based, at least in part, on the encoded speech signal with a long-term Linear Predictive Coding (LPC) filter.

5. The computer-implemented method as described in claim 4, wherein generating the output signal is further based on filtering a second signal based, at least in part, on the encoded speech signal, with a short-term LPC filter.

6. The computer-implemented method of claim 1, wherein receiving the encoded speech signal further comprises receiving the encoded speech signal via an Internet connection.

7. The computer-implemented method of claim 1, wherein the offset value comprises a predetermined offset value selected from of a plurality of predetermined offset values.

8. A decoder apparatus for decoding an encoded speech signal, the decoder comprising:

one or more processors;

an input module embodied, at least in part, with one or more processor-executable instructions stored on one or more computer-readable storage memory which, responsive to execution by at least one processor of the one or more processors, are configured to enable the input module to:

receive an encoded speech signal having quantization values; and determine from the encoded speech signal a transformation parameter, the transformation parameter comprising an offset value encoded in the encoded speech signal, the offset value based, at least in part, on a classification flag associated with the encoded speech signal;

a first transformation module embodied, at least in part, with one or more processor-executable instructions stored on one or more computer-readable storage memory which, responsive to execution by at least one processor of the one or more processors, are configured to enable the first transformation module to:

add to the quantization values simulated random-noise samples to produce a second signal; and a transform control module embodied, at least in part, with one or more processor-executable instructions stored on one or more computer-readable storage memory which, responsive to execution by at least one processor of the one or more processors, are configured to enable the transform control module to:

control transformation of the quantization values in dependence on said parameter by at least using a dither signal, the dither signal generated based, at least in part, on the offset value.

9. The decoder apparatus as described in claim 8, wherein the encoded speech signal comprises a plurality of frames and the offset value is encoded in the encoded speech signal once per frame.

10. The decoder apparatus as described in claim 9, wherein each frame includes a respective classification flag configured to indicate whether the encoded speech signal in the associated frame comprises a voiced frame or unvoiced frame.

11. The decoder apparatus as described in claim 8, the decoder further configured to generate an output signal based, at least in part, on filtering a first signal that is at least partially based on the encoded speech signal with a long-term Linear Predictive Coding (LPC) filter.

12. The decoder apparatus as described in claim 11, wherein the decoder is further configured to generate the output signal based, at least in part, on filtering a second signal that is at least partially based on the encoded speech signal, with a short-term LPC filter.

13. The decoder apparatus of claim 8 further configured to receive the encoded speech signal via a wireless transceiver.

14. The decoder apparatus of claim 8 further configured to generate the dither signal using a same seed value used to generate the encoded speech signal.

15. A system comprising:

at least one processor; and a computer program product for decoding an encoded speech signal, the program comprising code embodied on one or more computer-readable storage memory hardware devices which, responsive to execution by at least one processor, are configured to enable the system to:

receive an encoded speech signal having quantization values;

transform the quantization values by adding simulated random-noise samples; and from the encoded speech signal, determine a parameter of the transformation that is usable to control transformation of the quantization values, the parameter of the transformation comprising an offset value encoded in the encoded speech signal, the offset value comprising data used to generate a dither signal utilized in the transformation, the offset value based, at least in part, on a classification flag associated with the encoded speech signal.

16. The system as described in claim 15, wherein the encoded speech signal comprises a plurality of frames and the offset value is encoded in the encoded speech signal once per frame.

17. The system as described in claim 16, wherein each frame includes a respective classification flag configured to indicate whether the encoded speech signal in the associated frame comprises a voiced frame or unvoiced frame.

18. The system as described in claim 15 further configured to generate an output signal based, at least in part, on at least:

filtering a first signal that is at least partially based on the encoded speech signal with a long-term Linear Predictive Coding (LPC) filter; or filtering a second signal that is at least partially based on the encoded speech.

19. The system of claim 15 further configured to receive the encoded speech signal as part of a Voice-over-Internet Protocol (VoIP) connection.

20. The system of claim 15, wherein the encoded speech signal comprises a plurality of frames, and wherein the dither signal varies from frame to frame of the plurality of frames.

* * * * *